US008506263B2

(12) United States Patent
Chatfield

(10) Patent No.: US 8,506,263 B2
(45) Date of Patent: Aug. 13, 2013

(54) VACUUM PUMP

(75) Inventor: Francis Phillip Chatfield, Lansing (GB)

(73) Assignee: Edwards Limited, Crawley, West Sussex (GB)

( * ) Notice: Subject to any disclaimer, the term of this patent is extended or adjusted under 35 U.S.C. 154(b) by 1488 days.

(21) Appl. No.: 10/578,544

(22) PCT Filed: Nov. 9, 2004

(86) PCT No.: PCT/GB2004/004725
§ 371 (c)(1),
(2), (4) Date: Apr. 13, 2007

(87) PCT Pub. No.: WO2005/052374
PCT Pub. Date: Jun. 9, 2005

(65) Prior Publication Data

US 2007/0280845 A1 Dec. 6, 2007

(30) Foreign Application Priority Data

Nov. 14, 2003 (GB) ..... 0326613.7

(51) Int. Cl.
*F04B 39/02* (2006.01)

(52) U.S. Cl.
USPC ..... 417/366; 418/72; 418/201.2

(58) Field of Classification Search
USPC ..... 417/366, 365; 418/71, 72, 203, 418/201.1, 201.2
See application file for complete search history.

(56) References Cited

U.S. PATENT DOCUMENTS

| | | | | |
|---|---|---|---|---|
| 5,028,205 | A * | 7/1991 | Kapadia et al. | 415/112 |
| 5,863,317 | A | 1/1999 | Smith et al. | |
| 6,244,841 | B1 * | 6/2001 | Schofield et al. | 418/104 |

FOREIGN PATENT DOCUMENTS

| | | | |
|---|---|---|---|
| DE | 102 07 929 | A1 | 9/2003 |
| DE | 10207929 | A1 | 9/2003 |
| EP | 0 874 158 | A1 | 10/1998 |
| EP | 0874158 | A1 | 10/1998 |
| JP | 62-186073 | | 8/1987 |
| JP | 62-186073 | A | 8/1987 |
| JP | 5-296171 | | 11/1993 |
| JP | 5-296171 | A | 11/1993 |

OTHER PUBLICATIONS

Kazamaki Tadao; Patent Abstracts of Japan; abstract of JP 05296171; entitled Shaft Seal Mechanism for Positive Displacement Vacuum Pump without Using Sealing Fluid; publication date Nov. 9, 1993; Ulvac Japan Ltd.

(Continued)

*Primary Examiner* — Charles Freay
*Assistant Examiner* — Philip Stimpert
(74) *Attorney, Agent, or Firm* — Westman, Champlin & Kelly, P.A.

(57) ABSTRACT

A vacuum pump is provided comprising a pumping mechanism, a drive shaft for driving the pumping mechanism and a gear box connected to the drive shaft for rotating the drive shaft. Pressure control means are provided to define a path to allow fluid to flow from the pumping mechanism to the gear box in order to reduce the pressure difference therebetween. A reservoir is located within this path for collecting oil passing along the drive shaft from the gear box towards the pumping mechanism. In use, this enables pressurized fluid flowing from the pumping mechanism towards the gear box to urge oil which has collected in the reservoir, towards the gear box.

18 Claims, 3 Drawing Sheets

(56) References Cited

OTHER PUBLICATIONS

Kazamaki Tadao, Kozuka Ichiro, Nezuka Yukio; Patent Abstracts of Japan; abstract of JP 62186073 A; entitled Sealing Device for Rotary Vacuum Pump; publication date Aug. 14, 1987; Ulvac Corp.

United Kingdom Search Report of Application No. GB 0326613.7; Date of search: Mar. 29, 2004.

PCT International Search Report of International Application No. PCT/GB2004/004725; Date of mailing of the International Search Report: Feb. 10, 2005.

PCT Written Opinion of the International Searching Authority of International Application No. PCT/GB2004/004725; Date of mailing: Feb. 10, 2005.

* cited by examiner

VACUUM PUMP

FIELD OF THE INVENTION

This invention relates to the field of vacuum pumps, in particular reducing the maintenance burden relating to dry vacuum pumps.

BACKGROUND OF THE INVENTION

Such vacuum pumps can be used to evacuate a process chamber, through which hazardous/aggressive process gases may be passed to perform various functions in use. Dry vacuum pumps typically comprise one or more oil filled gear boxes. These are generally located remotely from the pump swept volume within the pumping apparatus. The swept volume accommodates the pumping mechanism which, in turn, is attached to and driven by the gear box, via one or more rotating shafts. It is important to prevent the transfer of oil from the gear box to the swept volume as oil would contaminate the process gases and potentially migrate to the process chamber, causing damage to the article being processed. It is also important to prevent particulate matter from the swept volume from reaching the gear box as this may cause contamination of the gear box oil and, consequently, reduce the reliability of the gear box components.

Conventionally, rotary seals are used around the rotating shafts to prevent transfer of oil from the gear box. However, it is very difficult to produce rotary seals which are suitably reliable and hardwearing. In trying to achieve these goals, exceptionally complex and expensive seals have conventionally been developed.

Loss of oil from the gear box not only causes potential contamination, but leads to degradation of the gear box itself if the volume of oil is significantly reduced. One conventional system collects such migrating oil but regular maintenance must be carried out to replenish the levels in the gear box and to empty the oil collection chambers.

It is an aim of the present invention to increase the maintenance interval by providing a system that prevents or significantly reduces the loss of oil from the pump.

SUMMARY OF THE INVENTION

According to the present invention there is provided a vacuum pump comprising:

- a pumping mechanism;
- a drive shaft for driving the pumping mechanism;
- a gear box connected to the drive shaft for rotating the drive shaft; and
- pressure control means defining a path to allow fluid to flow from the pumping mechanism to the gear box to reduce the pressure difference therebetween, and, located in said path, a reservoir for collecting oil passing along the drive shaft from the gear box towards the pumping mechanism so that, in use pressurised fluid flowing from the pumping mechanism towards the gear box urges oil collected in the reservoir towards the gear box.

By using the standard pressure cycle of the vacuum pump any oil collecting in the oil reservoir is regularly returned to the gear box such that the level of oil in the sump of the gear box is not significantly depleted over time.

The pressure control means may comprise one or more restrictions cooperating with the rotating shaft. These restrictions may define one or more chambers located along the length of the shaft. A first chamber may be proximate the pumping mechanism and a second chamber may be proximate the gear box.

The pressure control means may define a second path to allow fluid to flow from the gear box to the pumping mechanism to reduce the pressure difference therebetween. This second path may be defined, in part, by a bore within the drive shaft, the bore may have a fluid inlet proximate the gear box and a fluid outlet proximate a said chamber.

A non-return valve may be positioned in the first path between the oil reservoir and the gear box, the valve being arranged to be opened by pressurised fluid flowing from the pumping mechanism towards the gear box. This non-return valve may be activated by a pressure difference of 10 to 30 mbar. Such a sensitive valve ensures that each time the pressure rises (even minimally) in the swept volume in relation to the gear box, any collected oil will be returned to the sump. Preferably, the valve has an inlet connected to the reservoir and an outlet connected to a conduit for conveying oil towards the gear box, preferably to an oil sump.

BRIEF DESCRIPTION OF THE DRAWINGS

An example of the present invention will now be described with reference to the accompanying Figures in which.

DETAILED DESCRIPTION OF THE INVENTION

Figure 1:
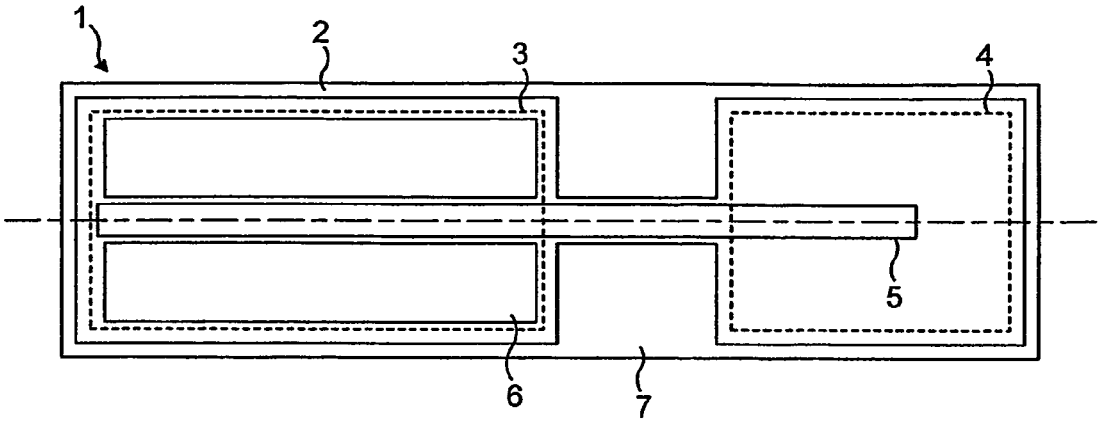
FIG. 1 illustrates a schematic representation of a vacuum pump.

A basic representation of a vertical cross section of a vacuum pump 1 can be seen in FIG. 1. A housing component 2 is provided which defines two primary internal cavities 3, 4. The first of these defines the swept volume 3 of the pumping mechanism of the pump, the rotor 6 of the pumping mechanism being located within the swept volume 3. The swept volume 3 has an inlet and an outlet (not shown) to allow the passage of process gases in use. The rotor 6 is mounted on a drive shaft 5 which rotates in use. The drive shaft 5 is coupled to a second drive shaft (not shown) by gears in the gear box 4 such that the two shafts rotate in synchronisation, allowing the rotors 6 mounted on the shafts 5 to intermesh and perform the pumping function. In order to try to maintain an oil free swept volume 3, sealing mechanisms are generally implemented along the shaft in region 7 between the swept volume 3 and the gear box 4 to prevent migration of oil to the swept volume 3 from gear box 4.

Figure 2:
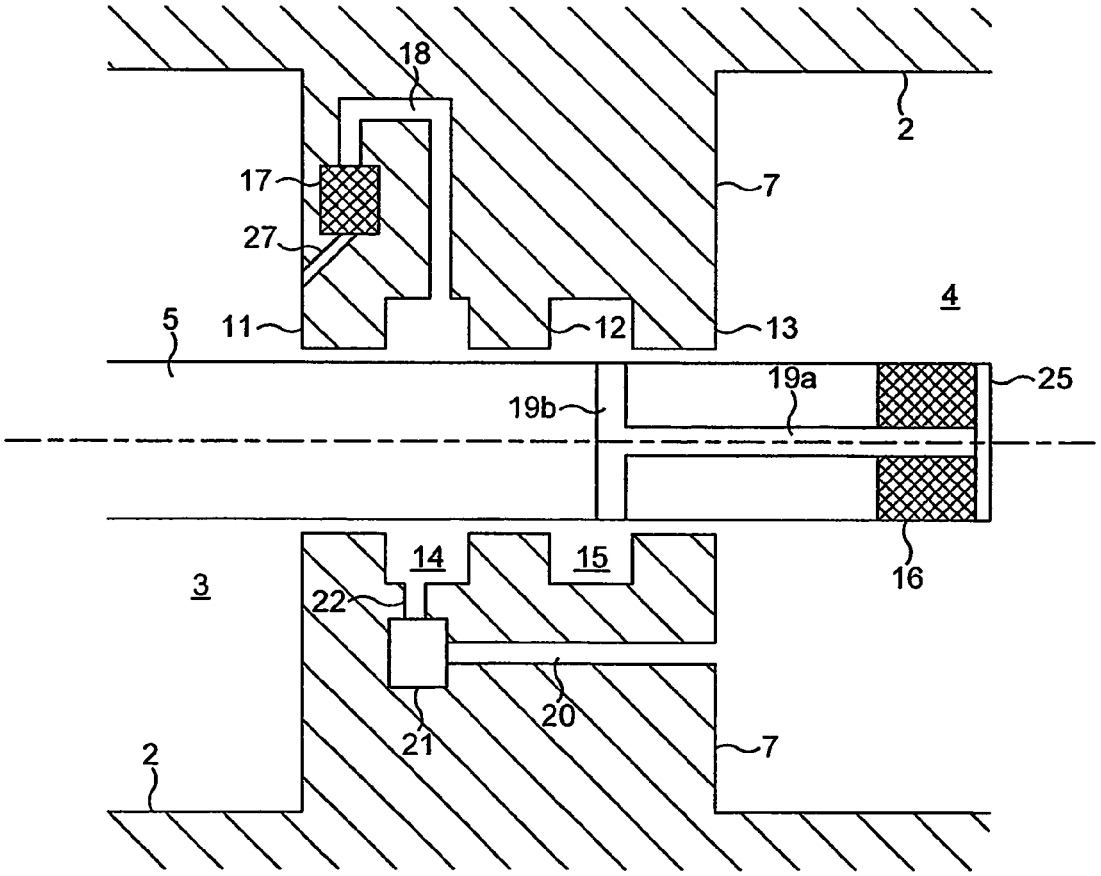
FIG. 2 illustrates a cross-section of a pump according to the present invention.
Figure 2A:
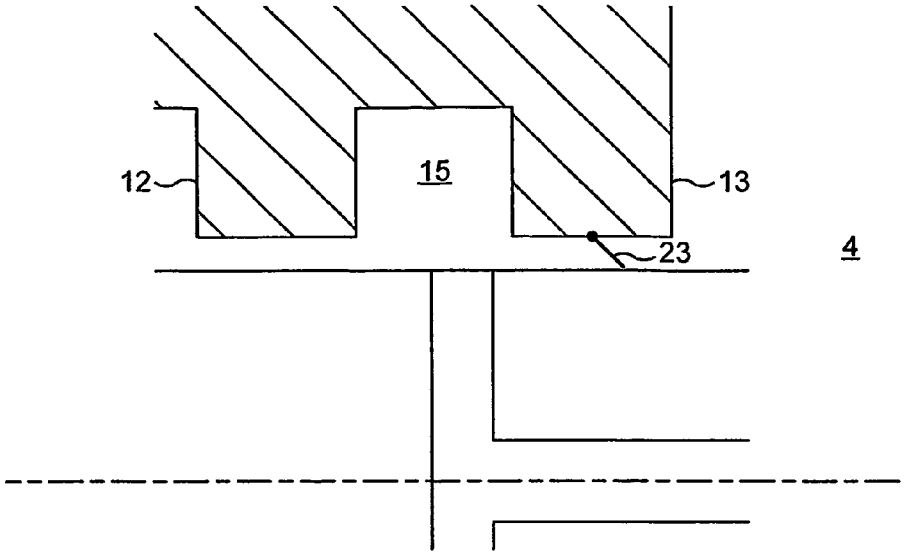
FIG. 2*a* shows an enlarged view of a restriction in FIG. 2.

FIG. 2 shows a more detailed schematic view of a section of a pump according to the present invention. Within region 7, pressure control elements 11, 12 and 13 are provided along the length of part of the drive shaft 5. In this example, the pressure control elements are restrictions formed as part of the housing component 2 to provide a close but generally non-contacting tolerance with shaft 5. These restrictions may alternatively be configured as illustrated in FIG. 2*a*, in which a resilient component 23 is fixed to the stationary housing thus forming a potentially contacting barrier between the housing 2 and the rotating shaft 5. Where the pressure is raised sufficiently in chamber 15, located between restrictions 12 and 13, the component 23 may deflect allowing gas to pass from chamber 15 to the gearbox 4. If, however the pressure is raised on the gear box side of component 23 the component will be deflected such that it is forced into contact with the shaft 5 such that the seal is enhanced and gas cannot pass from the gearbox 4 past restriction 13 to chamber 15.

In typical use of a vacuum pump, the ambient pressure in swept volume 3 will vary between high values (potentially up to atmospheric) and very low pressures, as may be found in high vacuum conditions. In normal usage, the different areas of the pump will be pressure balanced such that all of the components will be maintained at high vacuum conditions. In this way, the chances of regions of higher pressure fluid seeping to areas of low pressure are minimised such that high vacuum conditions are not inhibited. Consequently, it is necessary to reduce the pressure in the gear box 4 in line with the pressures experienced in the swept volume 3. This is achieved by providing free flow paths between the gear box 4 and the swept volume 3.

Figure 3:
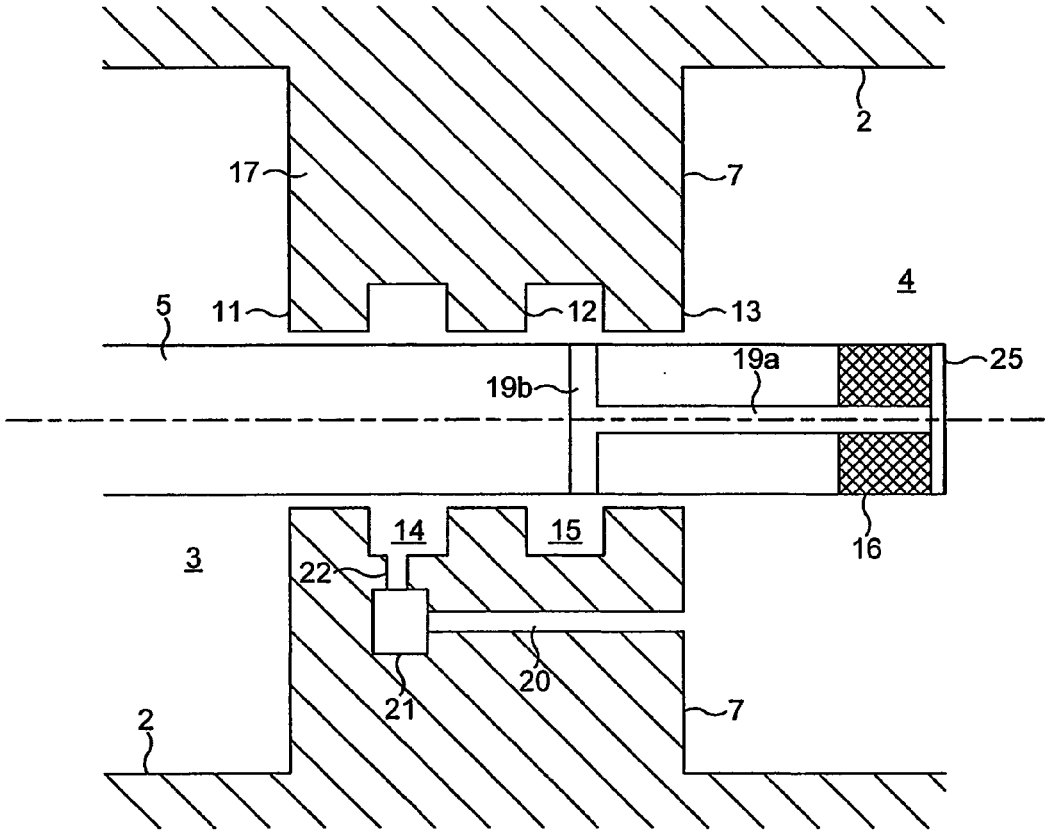
FIG. 3 illustrates a cross-section of a second pump according to the present invention.

The shaft 5 is provided with a central bore 19*a* which extends from the end of the shaft that lies within the gear box 4 to beyond the first restriction 13 as illustrated in FIG. 2. Radial passages 19*b* extend from this central bore 19*a* to the chamber 15 between restrictions 12 and 13. A filter 16 is provided on the end of the shaft to prevent (or at least minimise the amount of) oil from passing from the gear box 4 towards the swept volume 3. A further conduit 18, 27 is provided from the chamber 14 between restrictions 11 and 12 to the swept volume 3. Conduit 18, 27 comprises a filter 17 which removes particulate matter from process gases passing from the swept volume 3 towards the gear box 4. A third conduit 20 connects the chamber 14 with the gear box 4 via a non-return valve 21.

Where the process gas does not comprise particles or other contaminants, filter 17 and conduit 18, 27 may be omitted from the device as shown in FIG. 3. Optionally, restriction 11 may be omitted too, in this example, however it is configured to permit passage of gas in either direction.

Figure 4:
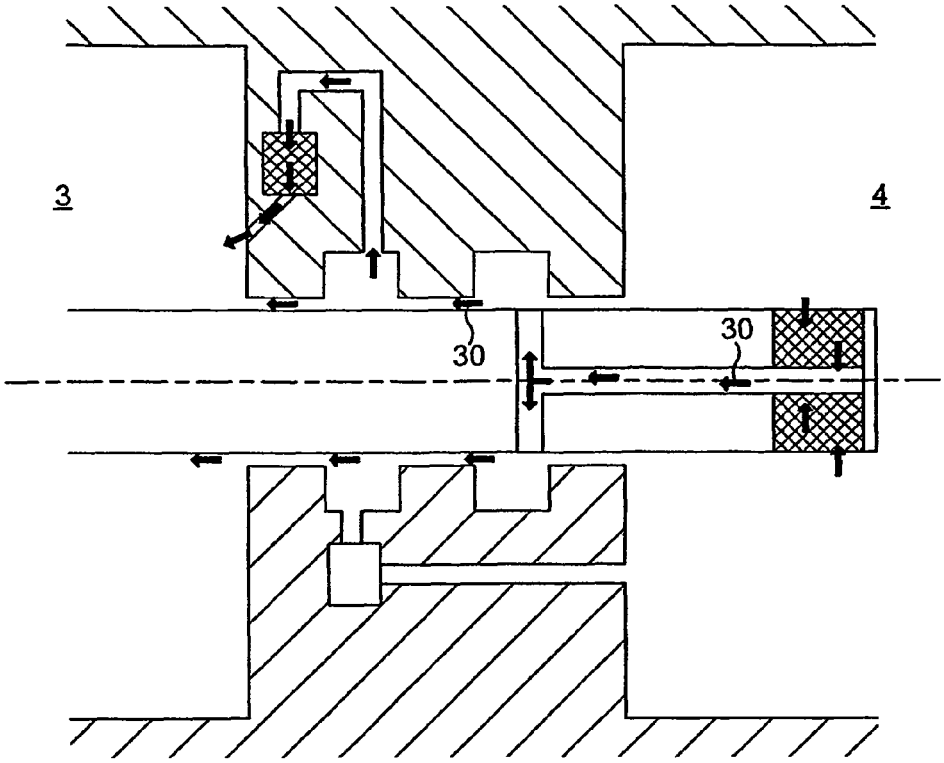
FIG. 4 illustrates a pump of FIG. 2 in use when the gear box pressure is higher than that of the swept volume.

In use, and assuming that the entire pump 1 is initially at atmospheric pressure, the pressure will drop first in the swept volume 3 as this becomes evacuated. With reference to FIG. 4, since restriction 13 inhibits fluid flow and the pressure gradient acting across the non return valve 21 will tend to oppose its opening so that valve 21 remains closed, the path of least resistance for the higher pressure gas within gear box 4 will be through filter 16 and central bore 19*a* and radial passages 19*b*. Filter 16 acts to remove any oil droplets which may otherwise be transported by the gas travelling from the high pressure region to the lower pressure region. This gas then enters chamber 15, where restriction 12 allows the gas to pass to chamber 14 and from there through conduit 18 and in to swept volume 3 via filter 17 and conduit 27. As shown in FIG. 4, the restrictions 11 to 13 define a first flow path (indicated by arrows 30) from gear box 4 to the swept volume 3. Restriction 11 may also allow some transmission of this gas from chamber 14 to the swept volume 3. Thus the pressure throughout the pump can be equalised.

Figure 5:
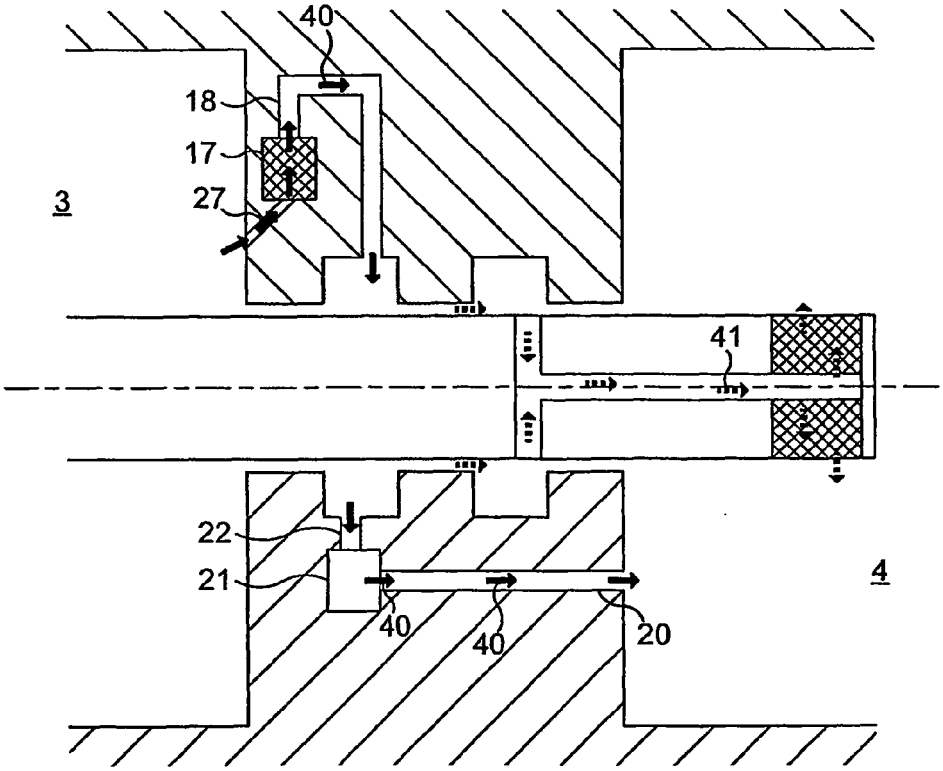
FIG. 5 illustrates a pump of FIG. 2 in use when the swept volume pressure is higher than that of the gear box.

The reverse process occurs (see FIG. 5) when the swept volume 3 increases in pressure in relation to the gear box 4, for example during a load lock pump down when the chamber being evacuated will initially return to higher pressures. Higher pressure gas from the swept volume 3 flows to the gear box 4 through the path of least resistance, that is, via filter 17, as restriction 11 is configured to inhibit flow from the swept volume 3 to chamber 14 when conduit 18, 27 is present. This filter 17 prevents particulate contaminants from the process gas reaching conduit 18 and subsequently to chamber 14. Such particulate materials would contaminate the oil and make it unsuitable for use in the gear box 4. Restriction 12 then provides an adverse pressure gradient to the gas such that the path of least resistance for the gas is through non-return valve 21 and conduit 20 which feeds directly in to the gear box 4 above the level of the oil in the sump (not illustrated). As shown in FIG. 5, the restrictions define a second flow path (indicated by arrows 40) from the swept volume 3 to the gear box 4. Minimal amounts of fluid may pass through conduits 19 and filter 16 (indicated by arrows 41). Through this mechanism, pressure can be equalised throughout the pump 1.

During use, oil collects under gravity in reservoir 22 beneath chamber 14. The oil in reservoir 22 is present due to, for example, imperfect sealing at restrictions 12 and 13 and any oil mist that may pass through filter 16 from the gear box 4.

As described above, during the pressure equalisation process where the gear box 4 is brought up to the same pressure as the remainder of the pump, relatively higher pressure gases will thus pass through reservoir 22 and activate non-return valve 21. Non-return valve 21 is preferably sensitive and so does not require a high fluctuation/difference in pressure to be opened, typically a pressure difference of 10 to 30 mbar will be sufficient to open the valve. Once opened, oil may be returned to the main sump of gear box 4. In practice, this oil return process will occur each time the pressure in the swept volume 3 is greater than that found in the gear box 4. Thus any oil that does leak along the shaft 5 will, automatically, be returned to the sump in the gear box 4, rather than having to be periodically drained from reservoir 22.

Since the inventory of oil is retained in this way the requirement for maintenance to replenish the oil in the gear box 4 or to empty any reservoirs is significantly reduced.

In the example where restriction 11, filter 17 and conduit 18, 27 are not required, the chamber 14 may be combined with the swept volume 3 such that any oil being transmitted as far as the pumping mechanism 6 is removed during the next pressure fluctuation cycle. In this case, the non-return valve 21 and oil reservoir 22 could be located at the base of the swept volume 3 formed within the housing 2, and so any oil that may pass through to the swept volume 3 is collected by gravity in the reservoir 22 and subsequently returned to the gear box 4. Preferably, however, (as illustrated in FIG. 3) restriction 11 is retained to provide an additional barrier to oil trying to pass into the swept volume 3. In this configuration, the oil collection point, reservoir 22 is located remotely from the swept volume so that the presence of oil therein may be minimised.

I claim:

1. A vacuum pump comprising:

a pumping mechanism;

a drive shaft for driving the pumping mechanism;

a gear box connected to the drive shaft for rotating the drive shaft; and pressure control means defining a path to allow fluid to flow from a swept volume of the pumping mechanism into the gear box and vice versa to reduce the pressure difference therebetween, wherein a part of the path is defined by a first conduit extending between the pumping mechanism and the gear box and being separate from and other than a fluid passage along the drive shaft, and, located in said path, a reservoir for collecting oil passing via the fluid passage along the drive shaft from the gear box towards the pumping mechanism so that, in use, pressurised fluid flowing from the pumping mechanism towards the gear box urges oil collected in the reservoir towards the gear box via a second conduit separate from and other than the fluid passage along the drive shaft.

2. The vacuum pump according to claim 1 wherein the pressure control means comprises a restriction cooperating with the rotating shaft.

3. The vacuum pump according to claim 2 wherein the restriction defines a chamber located along the length of the shaft.

4. The vacuum pump according to claim 2 wherein the restriction defines a first chamber proximate the pumping mechanism and a second chamber proximate the gear box.

5. The vacuum pump according to claim 3 wherein the pressure control means define a second path to allow fluid to flow from the gear box to the pumping mechanism to reduce the pressure difference therebetween.

6. The vacuum pump according to claim 5 wherein the second path is defined in part by a bore within the drive shaft.

7. The vacuum pump according to claim 6 wherein the bore has a fluid inlet proximate the gear box and a fluid outlet proximate said chamber.

8. The vacuum pump according to claim 1 wherein a non-return valve is located in the path and between the oil reservoir and the gear box, the valve being arranged to be opened by pressurised fluid flowing from the pumping mechanism towards the gear box.

9. The vacuum pump according to claim 1 wherein the first conduit is provided with a filter for removing particulates from the fluid passing therethrough.

10. The vacuum pump according to claim 1 wherein the pressure control means define a second path to allow fluid to flow from the gear box to the pumping mechanism to reduce the pressure difference therebetween.

11. The vacuum pump according to claim 2 wherein the pressure control means define a second path to allow fluid to flow from the gear box to the pumping mechanism to reduce the pressure difference therebetween.

12. The vacuum pump according to claim 4 wherein the pressure control means define a second path to allow fluid to flow from the gear box to the pumping mechanism to reduce the pressure difference therebetween.

13. The vacuum pump according to claim 7 wherein a non-return valve is located in the path and between the oil reservoir and the gear box, the valve being arranged to be opened by pressurised fluid flowing from the pumping mechanism towards the gear box.

14. The vacuum pump according to claim 6 wherein a non-return valve is located in the path and between the oil reservoir and the gear box, the valve being arranged to be opened by pressurised fluid flowing from the pumping mechanism towards the gear box.

15. The vacuum pump according to claim 5 wherein a non-return valve is located in the path and between the oil reservoir and the gear box, the valve being arranged to be opened by pressurised fluid flowing from the pumping mechanism towards the gear box.

16. The vacuum pump according to claim 4 wherein a non-return valve is located in the path and between the oil reservoir and the gear box, the valve being arranged to be opened by pressurised fluid flowing from the pumping mechanism towards the gear box.

17. The vacuum pump according to claim 2 wherein a non-return valve is located in the path and between the oil reservoir and the gear box, the valve being arranged to be opened by pressurised fluid flowing from the pumping mechanism towards the gear box.

18. The vacuum pump according to claim 5 wherein at least one of the first conduit and second conduit is provided with a filter for removing particulates from the fluid passing therethrough.

* * * * *

UNITED STATES PATENT AND TRADEMARK OFFICE

CERTIFICATE OF CORRECTION

PATENT NO. : 8,506,263 B2
APPLICATION NO. : 10/578544
DATED : August 13, 2013
INVENTOR(S) : Francis Phillip Chatfield It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1947 days.

Signed and Sealed this
Fifteenth Day of September, 2015

Michelle K. Lee

Michelle K. Lee
*Director of the United States Patent and Trademark Office*